US007828707B2

(12) United States Patent
Lee et al.

(10) Patent No.: US 7,828,707 B2
(45) Date of Patent: Nov. 9, 2010

(54) IMAGE DRUM FOR SELECTIVELY ABSORBING TONER THEREON

(75) Inventors: Chang Seung Lee, Yongin-si (KR); Kwang Choon Ro, Yongin-si (KR); Kae Dong Back, Yongin-si (KR); Kyu Ho Shin, Seoul (KR); Jong Kwang Kim, Incheon (KR); Won Kyoung Choi, Suwon-si (KR); Ki Deok Bae, Yongin-si (KR); Soon Cheol Kweon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1092 days.

(21) Appl. No.: 11/519,908

(22) Filed: Sep. 13, 2006

(65) Prior Publication Data

US 2007/0144009 A1 Jun. 28, 2007

(30) Foreign Application Priority Data

Dec. 28, 2005 (KR) ..... 10-2005-0131122

(51) Int. Cl.
*B05C 1/08* (2006.01)
*B41J 2/00* (2006.01)

(52) U.S. Cl. ..... 492/9; 347/151

(58) Field of Classification Search ..... 492/9, 492/16; 29/895.2, 460; 430/325; 347/151, 347/141, 158; 399/159, 252, 264, 289
See application file for complete search history.

(56) References Cited

U.S. PATENT DOCUMENTS

| | | | | |
|---|---|---|---|---|
| 7,489,327 | B2 * | 2/2009 | Kweon et al. | 347/151 |
| 2007/0132827 | A1 * | 6/2007 | Bae et al. | 347/169 |
| 2007/0137776 | A1 * | 6/2007 | Back et al. | 156/245 |
| 2007/0138018 | A1 * | 6/2007 | Choi et al. | 205/127 |

FOREIGN PATENT DOCUMENTS

| | | |
|---|---|---|
| JP | 5-27761 U | 4/1993 |
| JP | 6-206340 A | 7/1994 |

* cited by examiner

*Primary Examiner*—John C Hong
(74) *Attorney, Agent, or Firm*—Sughrue Mion, PLLC

(57) ABSTRACT

An image drum for selectively adsorbing toner in a printing apparatus is provided. A method and a configuration of ring electrodes formed on an outside of a drum body is also provided. That is, a control board is mounted inside the drum body, of which a plurality of terminals is externally exposed in the cylindrical drum body, and a photocurable resin is coated on the circumferential surface. Ring electrodes are then formed on circumferential surface of the drum body, by rotating the drum body and allowing an ultraviolet ray through the mask pattern onto the drum body to harden the liquid photocurable resin after contacting a mask-patterned mold mask to the circumferential surface of the drum body.

5 Claims, 10 Drawing Sheets

IMAGE DRUM FOR SELECTIVELY ABSORBING TONER THEREON

CROSS-REFERENCE TO RELATED APPLICATIONS

This application claims priority from Korean Patent Application No. 10-2005-0131122, filed on Dec. 28, 2005, in the Korean Intellectual Property Office, the disclosure of which is incorporated herein by reference.

BACKGROUND OF THE INVENTION

1. Field of the Invention

Apparatuses and methods consistent with the present invention relate to an image drum for a printing apparatus, and more particularly, to an image drum which can improve productivity and reduce a manufacturing cost by simplifying a connecting method between ring electrodes formed on a circumferential surface of a drum body and a control board mounted with a control chip individually applying a voltage to the ring electrodes, and a method of manufacturing the image drum.

2. Description of Related Art

FIG. 1 is a perspective view illustrating a related art image-forming element according to a related art, and FIG. 2 is a partially enlarged cross-sectional view illustrating a portion of the circumferential wall of the image-forming element according to the related art. The image-forming element shown in FIGS. 1 and 2 is disclosed in U.S. Pat. No. 6,014,157 by reference.

Referring to FIGS. 1 and 2, a related art image-forming element 10 includes a hollow cylindrical drum body 12 which is made of metal, such as aluminum or an aluminum alloy. A plurality of circumferentially extending electrodes 14 are formed on the outer circumferential surface of the drum body 12. These electrodes 14 are electrically insulated from one another and from the drum body 12 and are covered by a thin layer of insulating material. The electrodes 14 may generally be designed in various manners depending on the desired resolution of the images to be formed, but are preferably, but not necessarily, provided densely over the whole length of the drum body 12 and arranged with a pitch of, for example, about 40 μm in order to realize a resolution of approximately 600 dpi.

An elongate-shaped control unit 16 is mounted inside of the hollow drum body 12 such that a terminal array 18 formed at a longitudinal side face of the control unit 16 adjoins the internal wall of the drum body 12. The control unit 16 is arranged for individually applying a suitably high voltage to each of the electrodes 14 via the terminal array 18 in accordance with the desired image formation. As shown in FIG. 2, the individual electrodes 14 are formed as grooves separated by adjacent insulating ridges 20 and are filled internally with electrically conductive material 32. Since the electrically conductive material 32 fills in a small diameter hole 24 and a large diameter hole 26 constituting a through-hole 22, the electrodes 14 are electrically connected to zebra-strips 36 disposed at the inner wall surface of the drum body 12 via the through-hole 22. In this case, an anodized surface layer 34 is present at the outer circumferential surface of the drum body 12 and at the internal wall of the through-holes so as to electrically insulate the drum body 12 and the electrodes 14 from each other.

In order to manufacture the image-forming element 10, the cylindrical drum body 12 is provided. The grooves are cut into the outer circumferential surface of the drum body 12, for example by means of a diamond chisel to have a pitch of approximately 40 μm and a width of approximately 20 μm to form the electrodes 14. Alternatively, these grooves may be formed on the outer circumferential surface of the drum body 12 by means of a laser beam or an electron beam.

In the next step, the large diameter holes 26 are cut into the wall of the drum body 12 from inside by, for example, a means for a laser beam. The small diameter holes 24 may also be formed with a laser beam, either from the inside or outside of the drum body 12 to thereby form the through-holes 22. After the through-holes 22 including the small diameter holes 24 and the large diameter holes 26 have been formed, the whole drum body 12 is anodized so as to form the insulating metal oxide layer 34 on the whole surface of the drum body 12. Thereafter, the electrically conductive material 32 fills in the grooves and the through-holes 22. The outer or inner circumferential surface of the drum body 12 is cut to a predetermined depth through polishing so as to effectuate the electrodes 14 and electrical connection portions inside of the through-holes 22. An insulating layer is formed on the outer circumferential surface of the drum body 12 and the control unit 16 is disposed inside of the drum body 12 so as to complete the manufacture of the image-forming element 10.

As described above, in order to form the electrodes 14 on the outer circumferential surface of the drum body 12, the grooves are densely formed over the whole length of the drum body 12 using a precise cutting tool and the through-holes 22 must be formed at regular intervals either from the inside or outside of the drum body 12. Also, after the formation of the anodized surface layer on the outer circumferential surface of the drum body 12 and at the internal wall of the through-holes 22, the electrically conductive material 32 is filled into the grooves and the through-holes 22 and then removed until a desired thickness remains. It is particularly difficult to make a pattern of a line in the metal of the surface of the drum body 12 since the surface of the drum body is curved.

In general, it is difficult to form a mold of a photoresist by photolithography on a curved surface. Also, a gravure printing method may be considered, but a resolution of 600 dpi (dots per inch) may not be possible because ring electrodes with a pitch of about 40 μm may not be able to be realized.

Also, a technology, such as a nano-printing technology or an nano imprinting technology, may make a small sized pattern less than 10 ηm. However, the technology is generally applied to a flat surface and an additional etching process is needed.

SUMMARY OF EXEMPLARY EMBODIMENTS OF THE INVENTION

The present invention provides an image drum which can improve productivity and reduce a manufacturing cost by easily forming ring electrodes on the curved circumferential surface of a drum body, and a method of manufacturing the image drum.

The present invention also provides an image drum which can simplify a manufacturing process, in comparison to a related art imprinting technology, by eliminating processes of forming a metal film and etching thereof, and also can improve a method of manufacturing the image drum by directly creating a pattern to fabricate ring electrodes, and thereby improve a production speed of an inexpensive printer.

The present invention also provides an image drum for a printer with a resolution of more than a 600 dpi resolution by densely providing the ring electrodes, and a method of manufacturing the image drum.

According to an aspect of the present invention, there is provided an image drum for selectively adsorbing a toner thereon so as to form an image, and a method of manufacturing the image drum. In this instance, a liquid photocurable resin is coated on a circumferential surface of the drum body after connecting a cylindrical drum body and a control board, of which a plurality of terminals are exposed to an outside of a cylindrical drum body. Then, a mask-patterned mold mask contacts with a circumferential surface of the drum body, and the drum body is rotated while being irradiated with an ultraviolet ray.

Ring electrodes are formed by irradiating an ultraviolet ray through a plurality of slits not formed with the transmission preventing film but formed among mask patterns, and hardening a photocurable resin. Then, an image drum is completed by removing an unhardened photocurable resin by soaking the drum body into a developing resolution, sintering the remaining resin at a high temperature, and connecting the ring electrodes and the terminals.

In this instance, the plurality of slits may be formed at regular intervals so that the ring electrode has a pitch of about 40 μl, while the transmission protection film may be made of Chromium (Cr). Also, the photocurable resin may contain an electrically conductive metal component.

According to another aspect of the present invention, there is provided an image drum for selectively adsorbing a toner thereon to form an image in a printing apparatus, the image drum comprising: a cylindrical drum body including a mounting hole in a longitudinal direction, and a plurality of ring electrodes, on which certain portions of a photocurable resin harden by exposing the same to an ultraviolet ray, wherein the ring electrodes are electrically insulated from each other and are arranged in parallel on an outer circumferential surface of the cylindrical drum body; and a control board including a control chip with a plurality of terminals, wherein each terminal may be individually connected to each respective ring electrode, and bonded to the mounting hole to externally expose the terminal;

The drum body further comprises a hollow area formed in the drum body, such that the mounting hole passes through the hollow area to provide the control board in the hollow area. Also, the control board is formed of a plurality of printed circuit boards, and each terminal on an individual printed circuit board has a regular pitch interval.

BRIEF DESCRIPTION OF THE DRAWING

The above and/or other aspects of the present invention will become apparent and more readily appreciated from the following detailed description, taken in conjunction with the accompanying drawings of which.

DETAILED DESCRIPTION OF THE EXEMPLARY EMBODIMENTS

Figure 1:
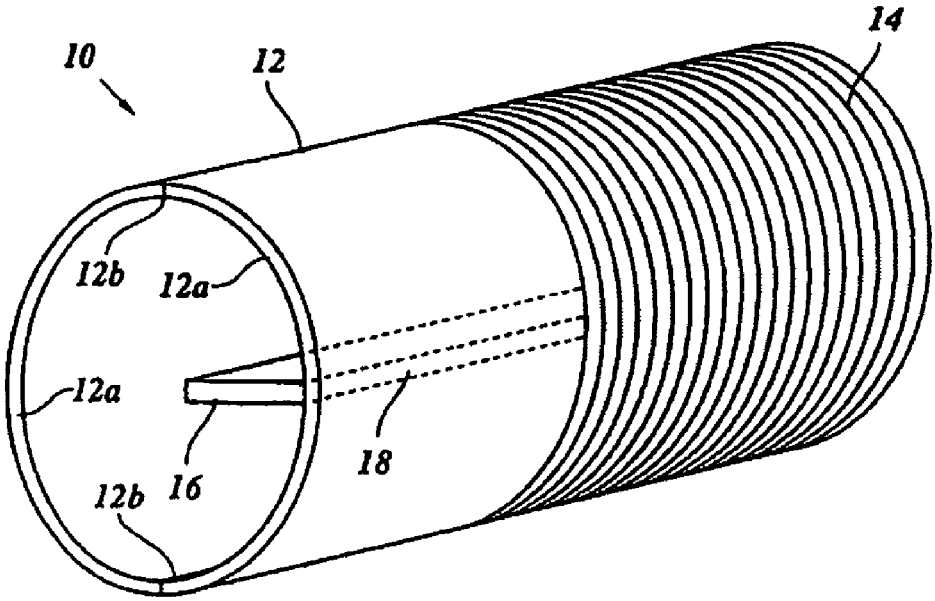
FIG. 1 (RELATED ART)
FIG. 1 is a perspective view illustrating a related art image-forming element.
Figure 2:
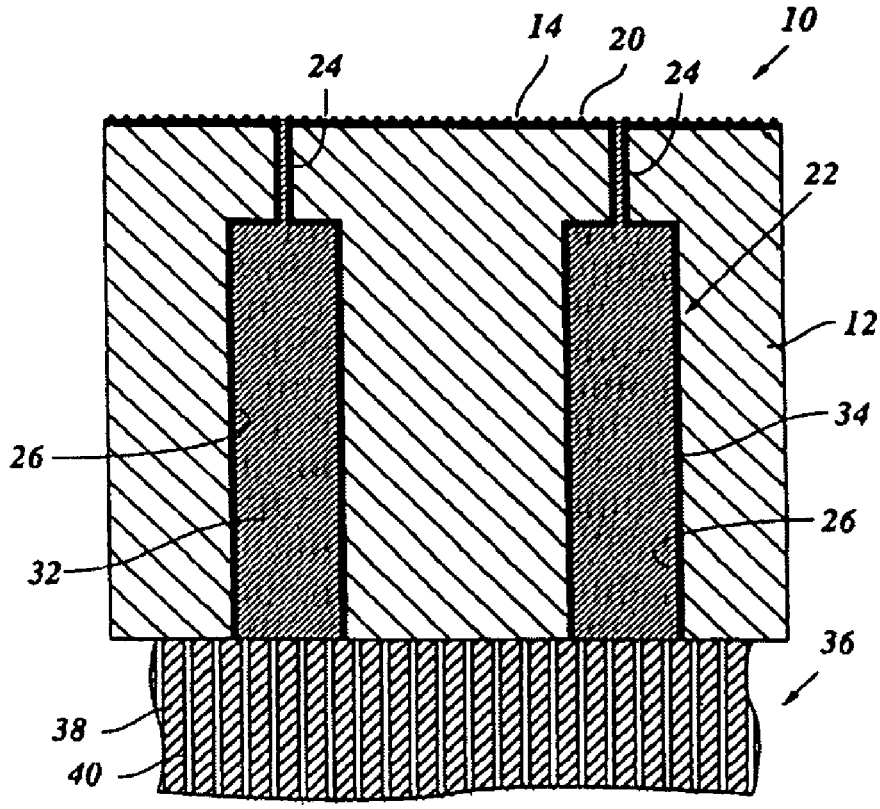
FIG. 2 (RELATED ART)
FIG. 2 is a partial enlarged cross-sectional view illustrating a portion of the circumferential wall of the related art image-forming element.

Reference will now be made in detail to exemplary embodiments of the present invention, examples of which are illustrated in the accompanying drawings, wherein like reference numerals refer to like elements throughout. The exemplary embodiments are described below in order to explain aspects of the present invention by referring to the figures.

Figure 3:
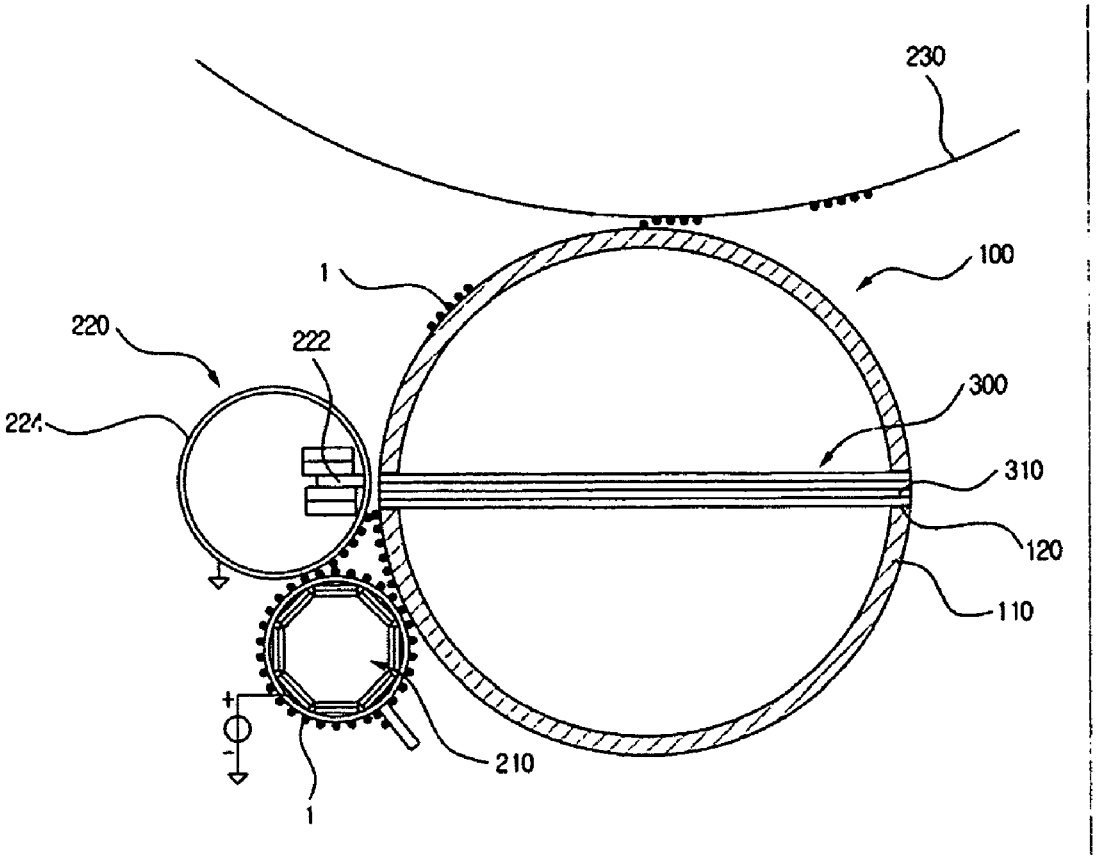
FIG. 3 is a cross-sectional view illustrating the internal configuration of a printer using an image drum according to an exemplary embodiment of the present invention.

FIG. 3 is a cross-sectional view illustrating the inner construction of a printer using an image drum according to an exemplary embodiment of the present invention.

Referring to FIG. 3, the image drum 100 includes a cylindrical drum body 110 and a control board 300 bonded to a mounting hole 120 of the drum body 110. A toner feed roller 210, a magnetic cutter 220 and an image transfer section 230 are disposed around the outer circumferential surface of the image drum 100. Toner 1 from a toner storage section (not shown) is supplied to the toner feed roller 210. The supplied toner 1 is transferred to the image drum 100 from the toner feed roller 210 while moving on the outer circumferential surface of the toner feed roller 210. In this instance, the toner 1 is kept in an electrically charged state, and is transferred to the magnetic cutter 220 while maintaining a contact with an insulating layer formed on the outermost circumferential portion of the image drum 100.

The magnetic cutter 220 includes a rotary sleeve 224, and a magnet 222 disposed within the magnetic cutter 220 for applying an attraction force to the toner 1. The magnet 222 is positioned adjacent to the image drum 100, and can attract the toner 1 adhered to the surface of the image drum 100 using a magnetic force. The magnet 222 has a magnetic force sufficient to collect the toner 1 from the electrodes of the image drum 100 which is not applied with a voltage. The toner 1 collected by the magnet 222 is fed back to the toner storage section or the toner feed roller 210 through the rotary sleeve 224.

The toner 1, which is not fed back to the toner storage section or the toner feed roller 210 by the magnetic cutter 220, is transferred to the image transfer section 230 from the outer circumferential surface of the image drum 100. Then, the toner 1 transferred to the image transfer section 230 is moved to a printing paper sheet which is in turn heat-treated so as to allow the toner 1 to be adhered to the surface of the printing paper sheet. To this end, the image drum 100 controls the voltage applied to the electrodes to conform to an image signal. Then, the image drum 100 generates an electrostatic force larger than that of the magnet 222 so as to prevent the toner 1 from being collected to the magnetic cutter 220.

Approximately five thousand electrodes are controlled independently so as to represent a two dimensional image on the image drum 100. The image represented on the image drum 100 through the toner 1 can be transferred to the printing paper sheet by using the image transfer section 230 as a relay means. After the toner 1 has been adhered to the surface of the printing paper sheet, the printing paper sheet passes through a heat-treatment apparatus. In this instance, the toner is adsorbed to the surface of the printing paper sheet to complete a corresponding printing.

Figure 4:
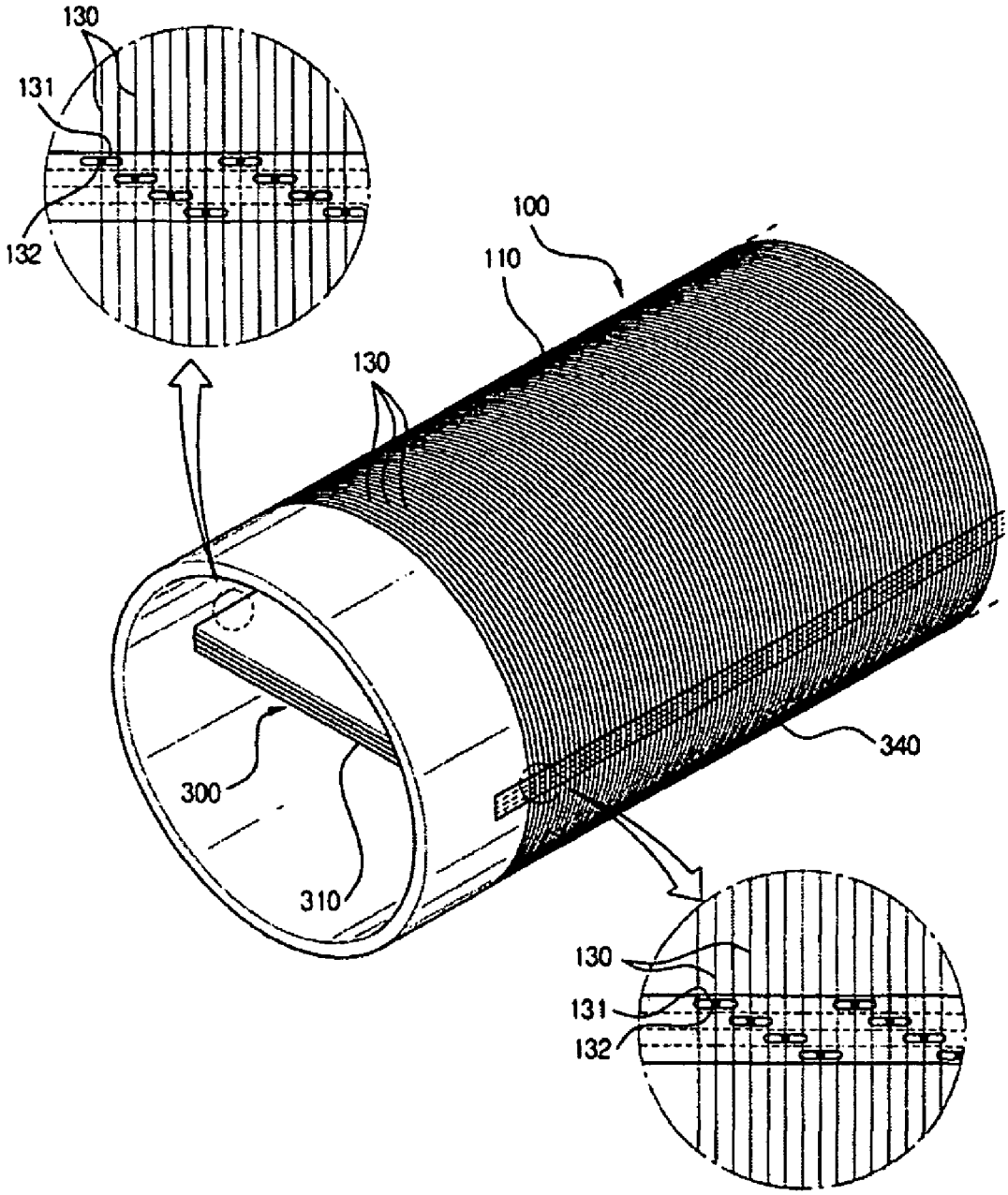
FIG. 4 is a perspective view illustrating the image drum shown in FIG. 3.

Hereinafter, a configuration of an image drum and a method of manufacturing the image drum according to an exemplary embodiment of the present invention will be described. FIG. 4 is a perspective view illustrating the image drum shown in FIG. 3.

As shown in FIG. 4, the drum body 110 is formed in a hollow cylindrical shape, and may be formed of a material having excellent heat conductivity and mechanical strength. Mounting holes 120, shown in FIG. 5, which are open in a longitudinal direction, and are disposed on an outside surface on opposite sides on a cross section of the drum body 110, respectively. The control board 300 is bonded to the mounting holes 120, to externally expose its side face. The control board 300 will be described later in detail.

The ring electrode 130 is provided on the circumferential surface of the drum body 110. The ring electrode 130 may be circumferentially formed on the circumferential surface of the drum body 110 to have a pitch of approximately 40 μm and a width of approximately 20 μm. The ring electrodes 130 covering the circumference of the drum body 110 are formed to have a width corresponding to the printing width of the printing paper sheet. As an example, assuming the printing paper sheet of A4 size, the drum body 110 is formed to have a length of about 20 to 22 cm over the whole width thereof. In this instance, each of the ring electrodes 130 may be formed to have a pitch of approximately 40 μm to achieve about five thousand lines. The ring electrodes 130 can be formed as a ring structure which is closed as one piece or partially opened. That is, both ends of each of the ring electrodes 130 may be electrically interconnected to form a closed ring structure, but it is possible to electrically insulate both ends of the each ring electrode 130 according to circumstances. The ring electrode 130 may be made of silver (Ag).

The control board 300 is provided with an control chip (not shown) which can individually apply a voltage to each of the ring electrodes 130. The control board 300 is formed by stacking four sheets of printed circuit boards 310 and includes a terminal array contacting with the ring electrode 130. The terminal array, which may be formed of copper (Cu), is formed on a side face of the control board 300, and is externally exposed on the circumferential surface of the drum body 110. An insulating material (not shown) is coated on the exposed surface of the control board 300.

The ring electrodes 130 must be connected to the control chip so as to control a voltage of each of the ring electrodes 130. The ring electrode 130 must initially contact with the terminal of the control chip, so as to be connected with the control chip.

Each terminal of the control board 310 is not connected in sequential order. Instead, a terminal exposed on one side is connected to even-numbered ring electrodes, such as the $2^{nd}$, $4^{th}$, $6^{th}$, etc. That is, the $1^{st}$ printed circuit board 310 is connected to the $2^{nd}$ ring electrode, the $2^{nd}$ printed circuit board 310 is connected to the $4^{th}$ ring electrode. The connection part 131 is formed in a length of about 80 μm, and each respective connection part of a control board is shifted and arranged in a pitch of approximately 80 μm from a center. In the center of the connection part 131, the vertical connection part 132, filled with a conductive material, is formed in a vertical direction and an individual terminal of the printed circuit board 310 is connected to one ring electrode 130. A circumference of the vertical connection part 132 is filled with an insulating material so as to prevent each ring electrode and each terminal from being shorted. In this way, a terminal exposed to an opposite side face is connected to a ring electrode of odd-numbers, such as the $1^{st}$, $3^{rd}$, $5^{th}$, etc. This is shown in the enlarged circle of FIG. 4.

A method of a manufacturing ring electrodes 130 according to an exemplary embodiment of the present invention is provided as follows.

Figure 5:
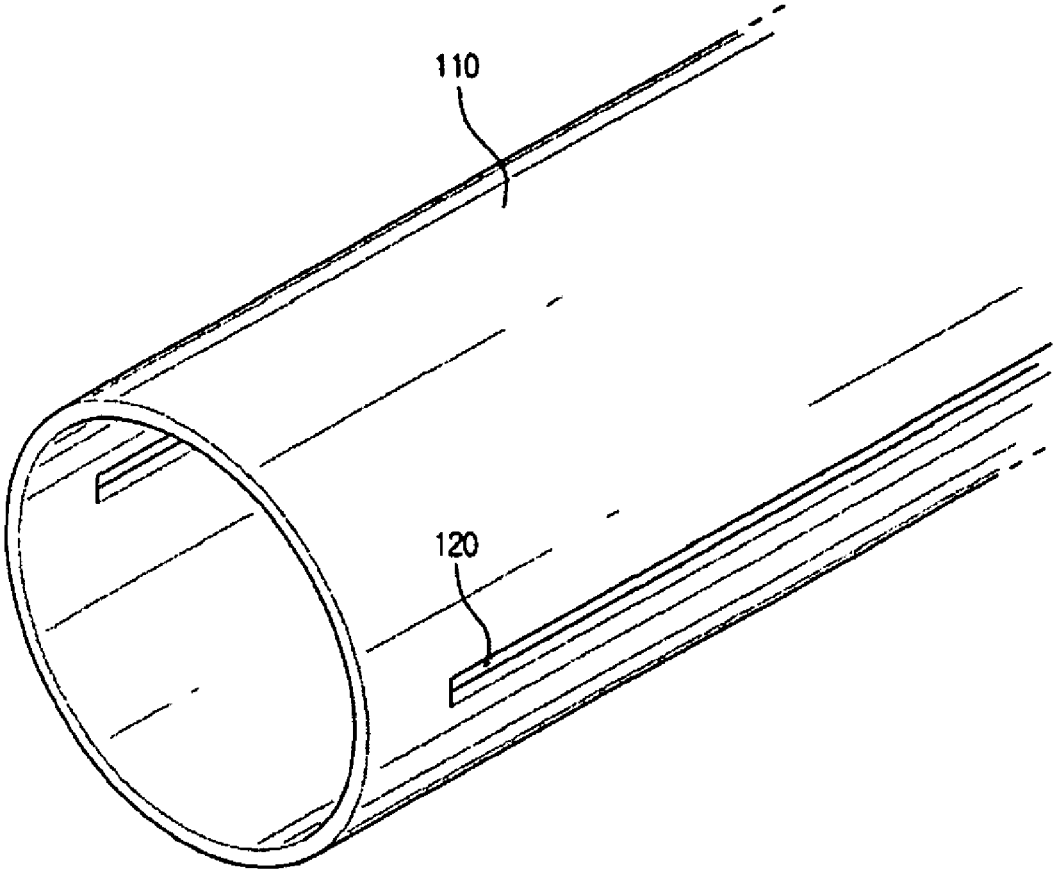
FIG. 5 is a perspective view illustrating a drum body according to an exemplary embodiment of the present invention.
Figure 6:
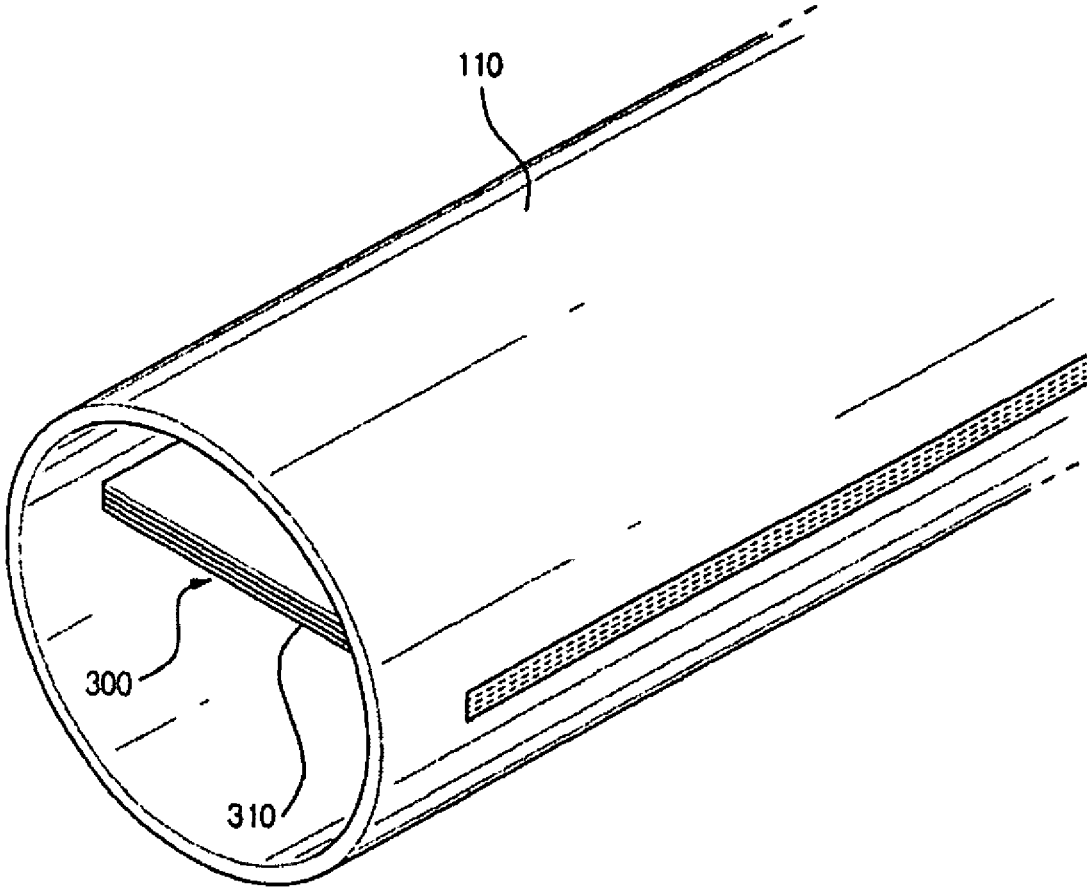
FIG. 6 is a perspective view illustrating a control board provided to the drum body shown in FIG. 5.
Figure 7:
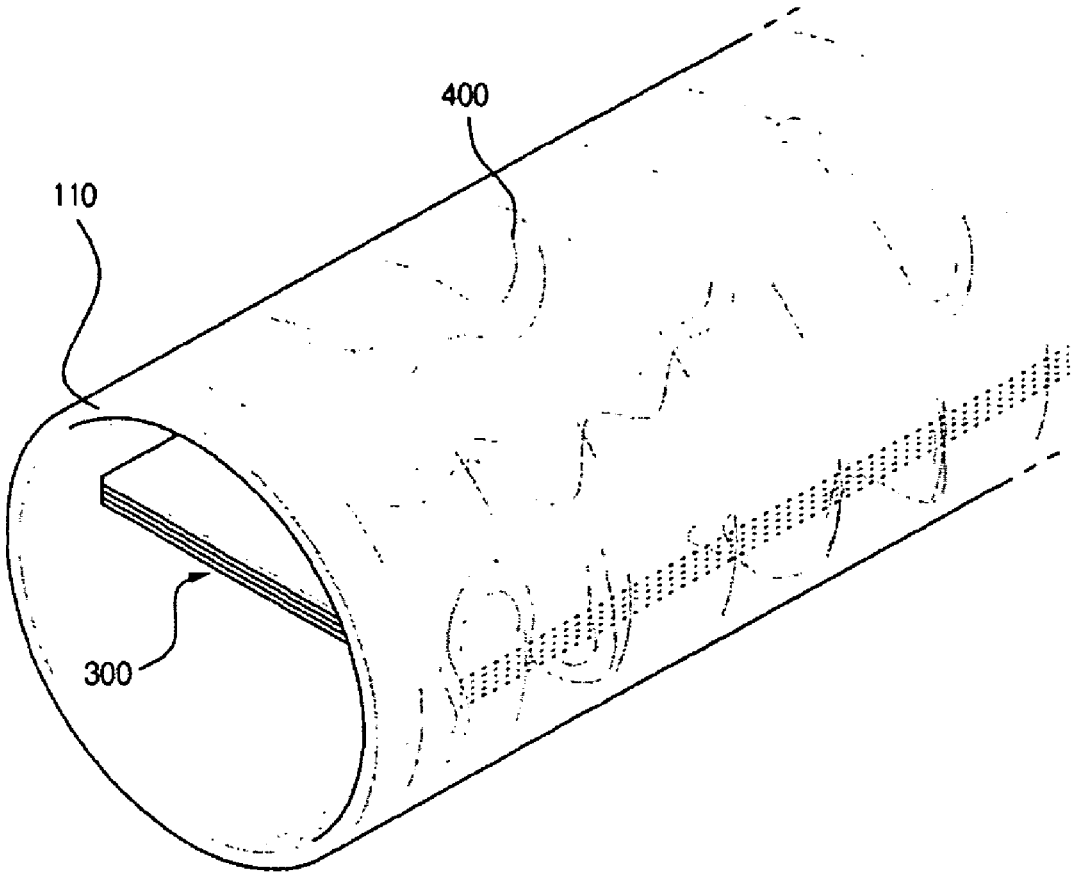
FIG. 7 is a perspective view illustrating a photocurable resin coated on the outer circumference of the drum body according to an exemplary embodiment of the present invention.
Figure 8:
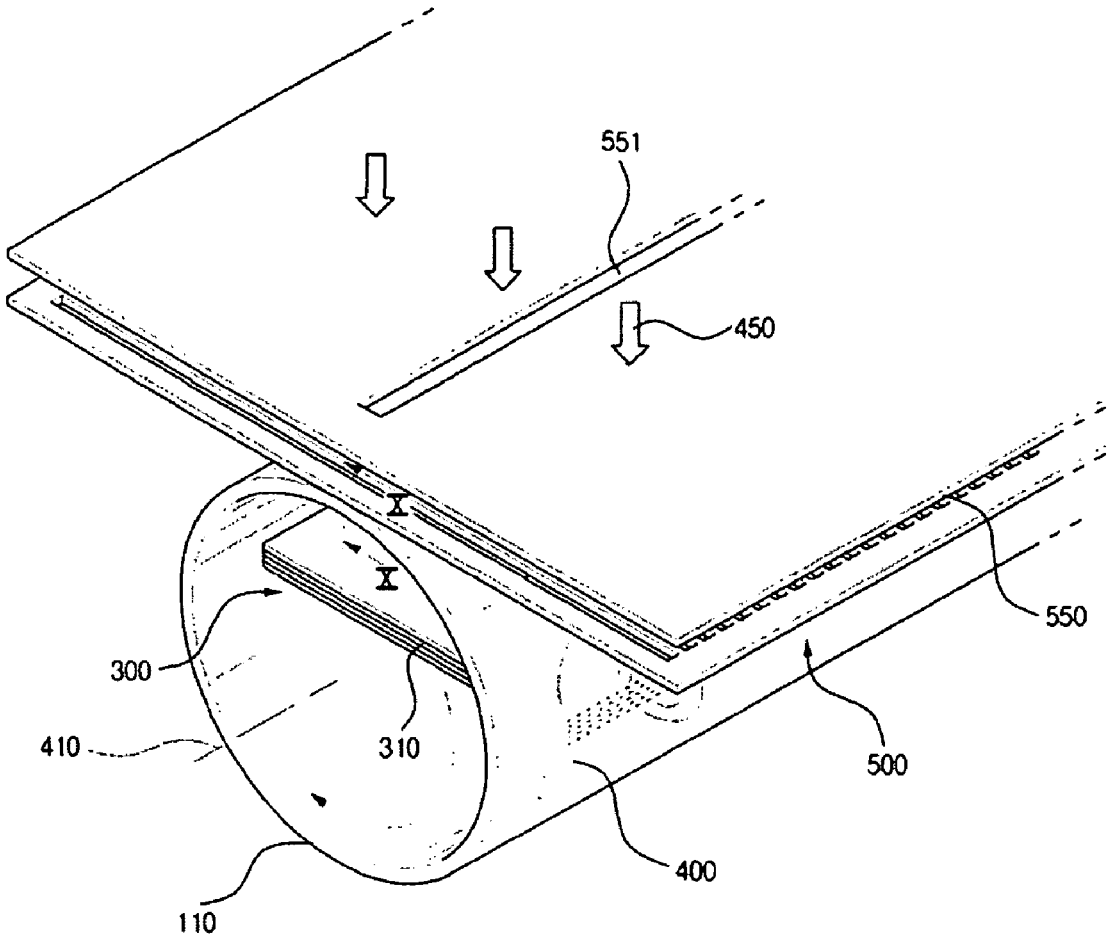
FIG. 8 is a perspective view illustrating contacting a mold mask with the drum body according to an exemplary embodiment of the present invention.
Figure 9:
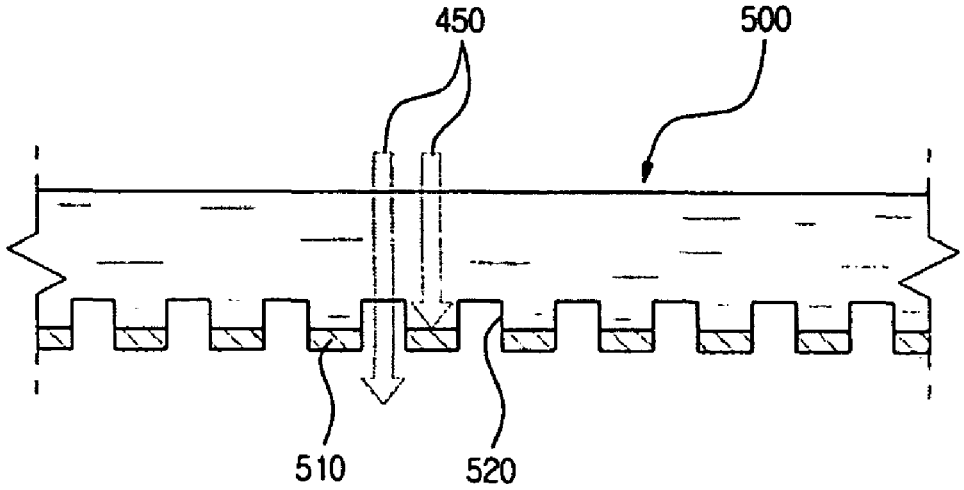
FIG. 9 is a cross-sectional view of the mold mask shown in FIG. 5.
Figure 10:
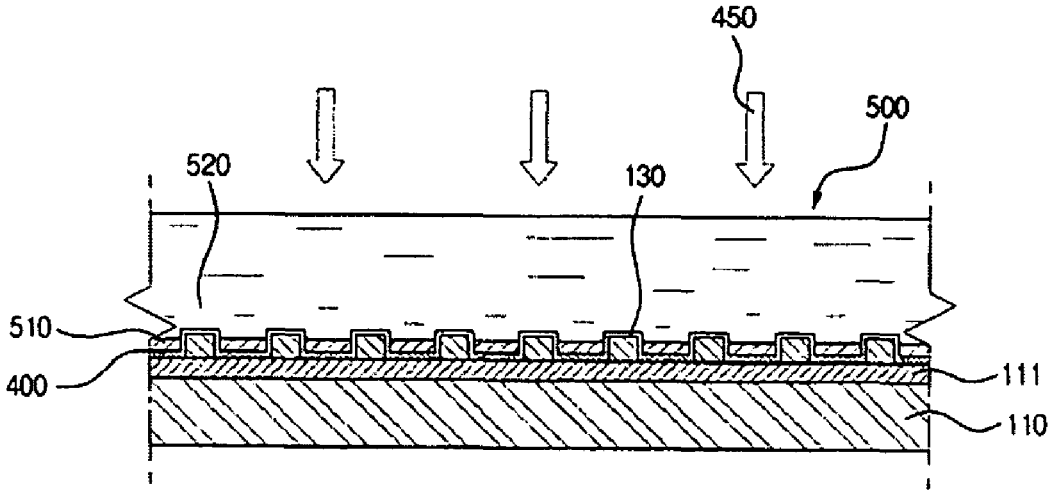
FIG. 10 is an enlarged cross-sectional view illustrating an X part of FIG. 8.
Figure 11:
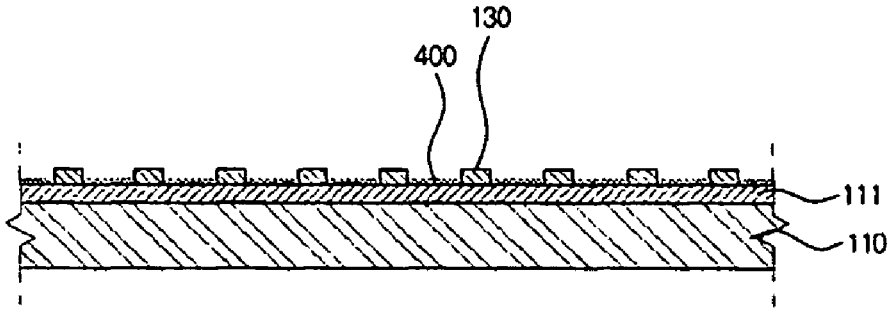
FIG. 11 is a cross-sectional view illustrating the drum body of FIG. 5 from which the mold mask is removed.
Figure 12:
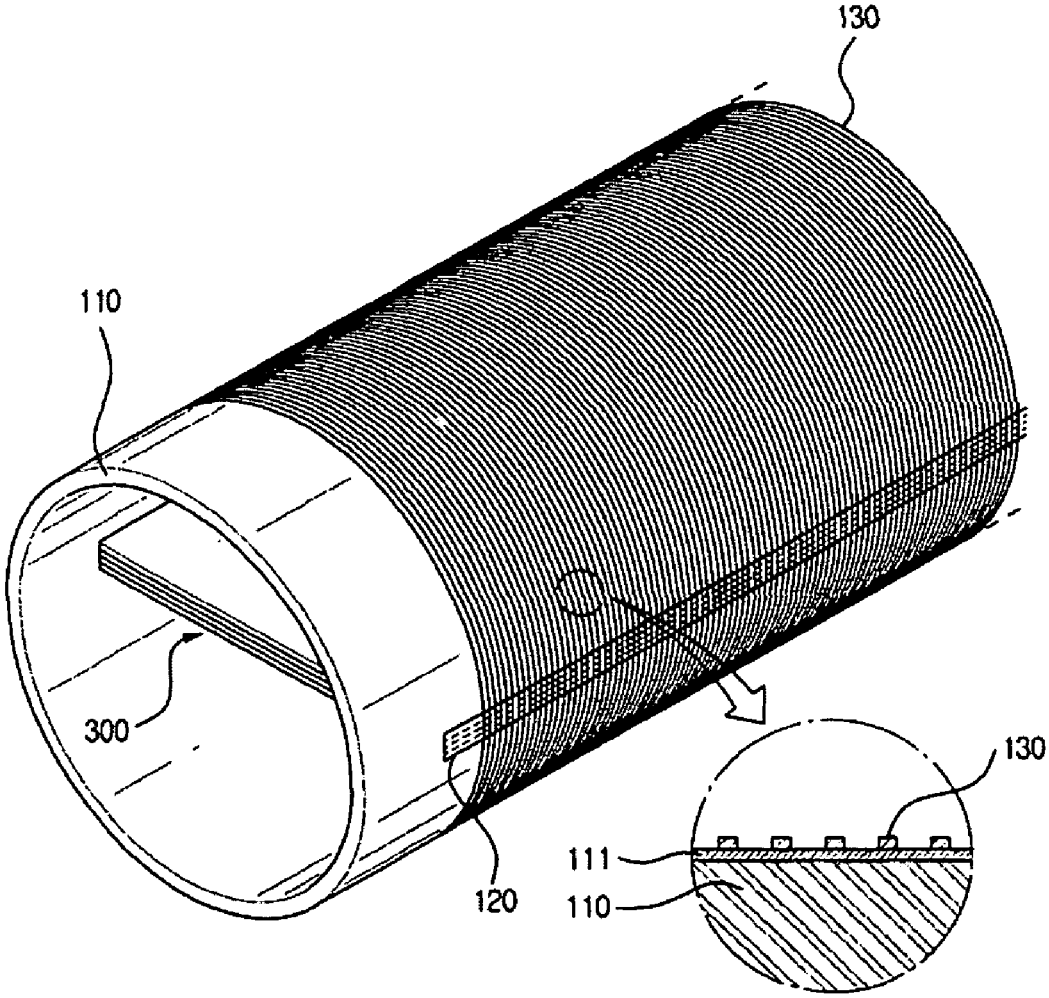
FIG. 12 is a perspective view illustrating the drum body of FIG. 5 after development.

FIG. 5 is a perspective view illustrating a drum body according to an exemplary embodiment of the present invention; FIG. 6 is a perspective view illustrating a control board provided to the drum body shown in FIG. 5; FIG. 7 is a perspective view illustrating a photocurable resin coated on the outer circumference of the drum body according to an exemplary embodiment of the present invention; FIG. 8 is a perspective view illustrating contacting a mold mask with the drum body according to an exemplary embodiment of the present invention; FIG. 9 is a cross-sectional view of the mold mask shown in FIG. 5; FIG. 10 is a cross-sectional view showing the enlarged view of part X of FIG. 8; FIG. 11 is a cross-sectional view illustrating the drum body of FIG. 5 from which the mold mask has been removed; and FIG. 12 is a perspective view illustrating the drum body of FIG. 5 after development.

First, as shown in FIG. 5, the drum body 110 is formed of a material having excellent heat conductivity and mechanical strength such as aluminum (Al), and is provided through cutting. In this instance, the drum body 110 is a cylindrical shape and includes mounting holes 120 in a longitudinal direction on an outside surface on opposite sides of the drum body 110.

A hollow area may be formed in the drum body 110. Also, grooves may be formed on the circumferential surface of the drum body 110 at regular intervals, to have a pitch of approximately 40 μm and a width of approximately 20 μm. The ring electrodes are disposed on the grooves. The hollow area is formed in the drum body 110 and the mounting hole 120 passes through to the hollow area and a control board is located in the hollow area.

As shown in the FIG. 6, the control board 300 is bonded to the mounting hole 120 of the drum body 110. A control chip for applying a voltage to each of a plurality of ring electrodes is mounted on the control board 300. The control board 300 is formed by stacking four sheets of a printed circuit board 310. The control board 300 is bonded to the mounting holes 120 of the drum body 110, to externally expose a plurality of terminals of the control chip. The terminal is formed on each printed circuit board 310, and the terminal on one sheet of printed circuit board 310 and another terminal formed on another sheet of printed circuit board 310 adjacent to the one sheet of printed circuit board 310 are provided to have a pitch of approximately 40 μm.

The exposed surface of the drum body 110 and the control board 300 may be processed by lathing. An electrically insulating layer can then be formed on the outer circumference of the drum body 110.

Next, as shown in FIG. 7, a photocurable resin 400 is applied to coat the circumferential surface of the drum body 110. The photocurable resin used in an exemplary embodiment of the present invention may be hardened due to a property of reacting to an ultraviolet light and may contain a metal in order to be electrically conductive. In other words, a photocurable resin 400 may be made of a metal-based resin or another electrically conductive material, as will be described later, to form ring electrodes by being hardened and readily conveying a voltage.

Next, as shown in FIG. 8, after contacting the flat mold mask 500 to the circumferential surface of the drum body 110, an ultraviolet ray 450 is irradiated onto a photocurable resin 400 while rotating the drum body 110 on a central axis 410. Then, a transmission preventing film 550 formed with the through-hole 551 is arranged on the top of the mold mask 500 so that the ultraviolet ray 450 passes through only the through-hole 551.

FIG. 9 illustrates the structure of the mold mask 500 in detail. As shown in FIG. 9, the mold mask 500 is made of a transparent material, the slits 520 are formed on a bottom surface. The slits 520 are similar to grooves sunken into the mold mask 500 and a plurality of slits are arranged at regular intervals.

The slits 520 allow transmission of the irradiated ultraviolet ray 450, while a space inside the slits 520 are where the ring electrodes are formed, thus, the intervals between the slits 520 are identical to intervals of the ring electrodes. That is, in order to form pitch intervals between the ring electrodes to be approximately 40 μm, pitch intervals of the slits 520 are required to be approximately 40 μm.

Protrusions are formed between the slits 520, and a transmission preventing film 510 is formed on the surface of the protrusions. The transmission preventing film 510 prevents transmission of an ultraviolet ray 450 through the mold mask 500 and may be made of chromium (Cr) or any other material which sufficiently prevents transmission of an ultraviolet ray.

As shown in FIG. 10, after contacting the flat mold mask 500 with the circumferential surface of the drum body 110, the irradiation by the ultraviolet ray 450 is performed, and a hardening takes place in the portion that receives the ultraviolet ray 450, and, as a result of the hardening, ring electrodes are formed. At this time, the ring electrodes 130 are formed on the electrically insulating layer 111 which is formed on the circumferential surface of the drum body 110.

More specifically, the ring electrodes 130 are formed due to the hardening effect of the irradiated ultraviolet ray 450 on the photocurable resin 400 in an inner space of the slits 520. However where the transmission preventing film 510 is formed, the photocurable resin 400 remains in a liquid state since the ultraviolet ray 450 is unable to irradiate beneath the transmission preventing film 510 to harden a photocurable resin 400. In other words, the ring electrodes 130 are formed inside a plurality of the slits 510, while an interval of the ring electrodes 130 identical to that of the transmission preventing film 510 is formed.

The ring electrode 130 is formed along a circumferential direction of the drum body 110 while the drum body 110 rotates. When the drum body 110 rotates, the mold mask 500 maintains contact with the circumferential surface of the drum body 110.

As shown in FIG. 11, as illustrated above, after removing the mold mask 500, the photocurable resin 400 under where slits are formed become hardened and the ring electrodes 130 are formed in a circumferential direction of the drum body 110, however, the photocurable resin 400 under where the transmission preventing film is formed is prevented from hardening so that the photocurable resin 400 remains in a liquid state.

As shown in FIG. 12, the drum body 110, with ring electrodes 130 formed on its circumferential surface, is soaked in a developing solution, taken out and processed. After processing, an unphotosensitized resin part is removed and only the hardened ring electrodes 130 remain on a circumferential surface of the drum body 110. The ring electrodes 130 and the drum body 110 are amalgamated to rigidly stick to each another by sintering below a temperature of about 150 □.

Then, as shown in FIG. 4, an image drum is completed by connecting each terminal of a control board 300 and the ring electrode 130. A method of connecting a ring electrode and a terminal is described above.

As described above, according to an exemplary embodiment of the present invention, ring electrodes may be densely formed by a simple manufacturing method. Also, in comparison to a related art imprinting method, an aspect of the present invention may simplify a manufacturing process and reduce a manufacturing cost by eliminating an etching process. Also, manufacture of ring electrodes may be easily accomplished in comparison to a related art.

Also, according to an exemplary embodiment of the present invention, there is provided a method of manufacturing an image drum which may embody a resolution of more than 600 dpi for a printer by a comparatively easy method of manufacturing densely formed ring electrodes. Accordingly, manufacturing cost may be reduced and thereby a popularization of the printer may be achieved.

Also, according to an exemplary embodiment of the present invention, a method of manufacturing may be simplified and a manufacturing cost may be reduced by eliminating an etching process.

Also, according to an exemplary embodiment of the present invention, ring electrodes requiring high precision may be comparatively easily manufactured by using a photocurable resin containing metal.

Although a few exemplary embodiments of the present invention have been shown and described, the present invention is not limited to the described exemplary embodiments. Instead, it would be appreciated by those skilled in the art that changes may be made to these embodiments without departing from the principles and spirit of the invention.

What is claimed is:

1. An image drum for selectively adsorbing toner thereon to form an image in a printing apparatus, the image drum comprising:

a cylindrical drum body including a mounting hole in a longitudinal direction, and a plurality of ring electrodes, on which certain portions of a photocurable resin harden by exposing the certain portions to an ultraviolet ray, wherein the plurality of ring electrodes are electrically insulated from each other and are arranged in parallel on an outer circumferential surface of the cylindrical drum body; and a control board including a control chip having a plurality of terminals, wherein each terminal may be individually connected to each respective ring electrode, and bonded to the mounting hole to externally expose the terminal.

2. The image drum of claim 1, wherein the photocurable resin contains an electrically conductive metal.

3. The image drum of claim 1, wherein the image drum is soaked in a developing solution and an unhardened liquid of the photocurable resin is removed.

4. The image drum of claim 1, wherein the drum body further comprises a hollow area formed in the drum body, and the mounting hole passes through the hollow area to provide the control board in the hollow area.

5. The image drum of claim 1, wherein the control board is formed of a plurality of printed circuit boards, and each terminal on an individual printed circuit board has a regular pitch interval.

* * * * *